US007691472B2

(12) United States Patent
Vinson et al.

(10) Patent No.: US 7,691,472 B2
(45) Date of Patent: Apr. 6, 2010

(54) INDIVIDUALIZED SEED HAIRS AND PRODUCTS EMPLOYING SAME

(75) Inventors: Kenneth Douglas Vinson, Cincinnati, OH (US); Teresa Jean Franklin, Ann Arbor, MI (US)

(73) Assignee: The Procter & Gamble Company, Cincinnati, OH (US)

( * ) Notice: Subject to any disclaimer, the term of this patent is extended or adjusted under 35 U.S.C. 154(b) by 703 days.

(21) Appl. No.: 11/436,501

(22) Filed: May 18, 2006

(65) Prior Publication Data

US 2006/0288639 A1 Dec. 28, 2006

Related U.S. Application Data

(60) Provisional application No. 60/693,458, filed on Jun. 23, 2005.

(51) Int. Cl.
*D04H 1/00* (2006.01)

(52) U.S. Cl. ..... 428/292.1

(58) Field of Classification Search ..... 428/292.1; 162/117

See application file for complete search history.

(56) References Cited

U.S. PATENT DOCUMENTS

| | | | | |
|---|---|---|---|---|
| 2,663,907 | A * | 12/1953 | Downing et al. | 536/56 |
| 3,301,746 | A | 1/1967 | Sanford et al. | |
| 3,825,381 | A | 7/1974 | Dunning et al. | |
| 3,949,035 | A | 4/1976 | Dunning et al. | |
| 3,974,025 | A | 8/1976 | Ayers | |
| 3,994,771 | A | 11/1976 | Morgan, Jr. et al. | |
| 4,100,324 | A | 7/1978 | Anderson et al. | |
| 4,191,609 | A | 3/1980 | Trokhan | |
| 4,257,842 | A * | 3/1981 | Ciaccia et al. | 162/117 |
| 4,261,139 | A | 4/1981 | Pogue | |
| 4,300,981 | A | 11/1981 | Carstens | |
| 4,637,859 | A | 1/1987 | Trokhan | |
| H1672 | H * | 8/1997 | Hermans et al. | 162/148 |
| 5,856,006 | A | 1/1999 | Asai et al. | |
| 6,163,943 | A | 12/2000 | Johansson et al. | |
| 6,174,412 | B1 * | 1/2001 | Paterson-Brown et al. | 162/95 |
| 2003/0093051 | A1 | 5/2003 | Malowaniec et al. | |
| 2004/0084167 | A1 | 5/2004 | Vinson et al. | |
| 2004/0231810 | A1 * | 11/2004 | Rousu et al. | 162/16 |
| 2005/0091811 | A1 * | 5/2005 | Billgren et al. | 28/104 |
| 2005/0238699 | A1 | 10/2005 | Kleinwaechter | |
| 2007/0011762 | A1 * | 1/2007 | Vinson et al. | 800/278 |

FOREIGN PATENT DOCUMENTS

WO WO 01/52911 A2 7/2001

OTHER PUBLICATIONS

Potikha, et al. "A Mutant of *Arabidopsis thaliana* Displaying Altered Patterns of Cellulose Deposition", *Plant Journal*, vol. 7, No. 3, pp. 453-460 (No. 3.).

(Continued)

*Primary Examiner*—D. L Tarazano
*Assistant Examiner*—Camie S Thompson
(74) *Attorney, Agent, or Firm*—C. Brant Cook

(57) ABSTRACT

Individualized seed hairs, methods for individualizing seed hairs, chemical derivatives of individualized seed hairs, seed hair-containing soft fibrous structures, single- or multi-ply sanitary tissue products comprising such fibrous structures and methods for making such fibrous structures and sanitary tissue products are provided.

13 Claims, 4 Drawing Sheets

OTHER PUBLICATIONS

Zhang, et al., "A Simple and Efficient Method for Isolating Trichomes for Downstream Analyses", *Plant and Cell Physiology*, vol. 45, No. 2, pp. 221-224 (Feb. 2004) XPOO2409939.

Kuhlein, et al., WSDOT-Ethnobotany-Herbs [Online] 1991-1994 XP002406397; retrieved from the Internet; URL:http://www.wsdot.wa.gov/Environment/CulRes/herbs.htm#Typha (retrieved on Nov. 9, 2006) Abstract.

TAN: "Cattails (*Typha augustifolia*") [Online] 2001, XP002406398; retrieved from the Internet: URL:http:/www.naturia.per.sg/buloh/plants/cattail.htm (retrieved on Nov. 9, 2006) Whole Documents, specialty uses.

U.S. Appl. No. 11/436,494, filed May 18, 2006, Kenneth Douglas Vinson, et al.

Kim, et al., "Cotton Fiber Growth in Planta and in Vitro. Models for Plant Cell Elongation and Cell Wall Biogenesis", *Plant Physiology*, vol. 127, pp. 1361-1366 (2001).

"The New Royal Horticultural Society Dictionary of Gardening", vol. 4, p. 359 (1992).

Compton. "Upper North Wakashan and Southern Timishian Ethnobotany: The Knowledge and Usage of Plants and Fungi Among the Oweekeno, Hanaksiala (Kitlope and Kemano), Haisla (Kitamaat) and Kitasoo Peoples of the Central and North Coasts of British Columbia", *The University of British Columbia, Ph.D. Thesis*, p. 256 (1993).

U.S. Appl. No. 11/436,494, filed May 18, 2006, Office Action dated Nov. 6, 2008.

* cited by examiner

INDIVIDUALIZED SEED HAIRS AND PRODUCTS EMPLOYING SAME

CROSS REFERENCE TO RELATED APPLICATIONS

This application claims the benefit of U.S. Provisional Application No. 60/693,458 filed on Jun. 23, 2005.

FIELD OF THE INVENTION

The present invention relates to individualized seed hairs, methods for individualizing seed hairs, seed hair-containing soft fibrous structures, single- or multi-ply sanitary tissue products comprising such soft fibrous structures and methods for making such soft fibrous structures and sanitary tissue products.

BACKGROUND OF THE INVENTION

Formulators of cellulose chemicals and soft fibrous structures are always looking for additional types of fibers in order to improve performance or reduce cost. Soft fibrous structures have conventionally been made with wood pulp cellulosic fibers. More recently, synthetic fibers have been used.

No prior art reference has disclosed liberating certain seed hairs to obtain individualized seed hairs and using seed hairs in soft fibrous structures.

Accordingly, there is a need for individualized seed hairs, methods for individualizing seed hairs, seed hair-containing soft fibrous structures, single- or multi-ply sanitary tissue product comprising such soft fibrous structures and method for making such soft fibrous structures and sanitary tissue products.

SUMMARY OF THE INVENTION

The present invention fulfills the need described above by providing individualized seed hairs, methods for individualizing seed hairs, a seed hair-containing soft fibrous structure, single- or multi-ply sanitary tissue product comprising such a soft fibrous structure and methods for making such soft fibrous structures and sanitary tissue products.

In one example of the present invention, an individualized seed hair is provided.

In another example of the present invention, a chemical derivative of an individualized seed hair is provided.

In another example of the present invention, a soft fibrous structure comprising individualized seed hairs is provided.

In another example of the present invention, a single- or multi-ply sanitary tissue product comprising a fibrous structure according to the present invention is provided.

In another example of the present invention, a mechanical method for individualizing a seed hair is provided.

In another example of the present invention, a chemical method for individualizing a seed hair is provided.

In yet another example of the present invention, a method for making a soft fibrous structure according to the present invention is provided.

In still another example of the present invention, a method for making a single- or multi-ply sanitary tissue product comprising a fibrous structure according to the present invention is provided.

In even yet another example, a method for making a seed hair-containing fibrous structure comprising the steps of:

a) preparing a fiber furnish (slurry) by mixing a seed hair with water;

b) depositing the fiber furnish on a foraminous forming surface to form an embryonic fibrous web; and c) drying the embryonic fibrous web, is provided.

Accordingly, the present invention provides an individualized seed hair, a method for individualizing seed hairs, a seed hair-containing soft fibrous structure, a single- or multi-ply sanitary tissue product comprising such a fibrous structure and methods for making such fibrous structures and sanitary tissue products.

DETAILED DESCRIPTION OF THE INVENTION

Definitions

Figure 1:
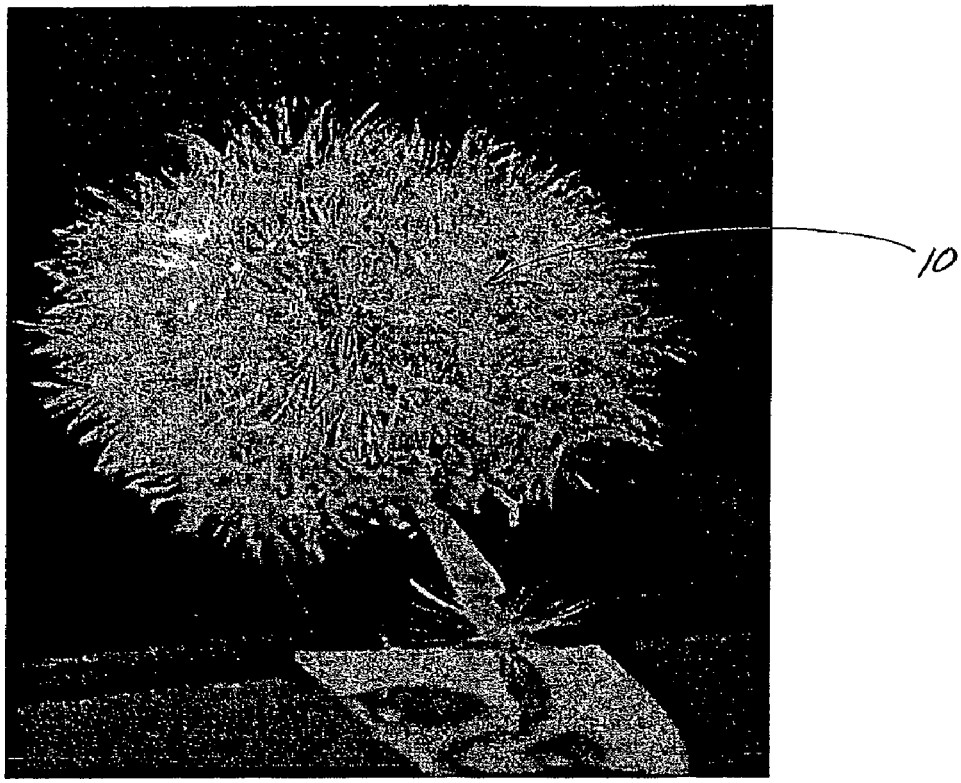
FIG. 1 is a light micrograph of a mature seed globe illustrating seed hairs present on the common dandelion *Taraxacum officinale;*

"Seed hair" as used herein means an epidermal (external and/or internal) attachment of a varying shape, structure and/or function of a seed portion, including the hairs contained within or upon the fruit case portion or pod, of a non-*gossypium* plant. In one example, a seed hair is an outgrowth of the epidermis of a seed portion of a non-*gossypium* plant. The outgrowth may extend from an epidermal cell. In one embodiment, the outgrowth is a seed hair fiber. The outgrowth may be a hairlike or bristlelike outgrowth from the epidermis of a seed portion of a plant.

Seed hairs may protect a seed and/or aid in the transport of a seed present on a plant. For example, seed hairs may regulate moisture or temperature for the seed, prevent the seed from being eaten by animals, and/or they may allow the seed to more easily become airborne so that it may be transported to a new location distant from the originating plant for germination and perpetuation of the species.

Cotton is a plant from the Malvacae family. Specifically cotton is from the genus *Gossypium*. Two common species of cotton are *Gossypium hirsutum* and *Gossypium barbadense*. A highly specialized industry has developed around such domesticated cotton plants. Methods of separating and cleaning cotton staple fibers and/or cotton linters fibers are well known and effective. However, they are unsuitable for use with other types of seeds.

Similarly, there is well developed technology to harvest staple length plant hairs arising from the fruit case or pod portion of certain plants. Staple length used herein means fibers at least exceeding an average length of about 7 mm. Kapok, *Ceiba pentrandra*, for example yields a very long fiber used for filling purposes. Milkweed, *Asclepias speciosa*, also yields pods and staple length fibers which have been harvested for various uses.

By contrast, individualized seed hairs according to the present invention are non-*gossypium* and at least about 0.4 mm but less than about 7 mm in fiber length. Further they have a coarseness of at least about 3.0 mg/100 m, but no more than about 30 mg/100 m.

The term "individualized seed hair" as used herein means seed hairs which have been artificially separated by a suitable method for individualizing seed hairs from a seed portion of the host non-*gossypium* plant. In other words, individualized seed hairs as used herein means that the seed hairs become separated from a seed portion of a host non-*gossypium* plant by some non-naturally occurring action. In one example, individualized seed hairs are artificially separated in a location that is sheltered from nature. Primarily, individualized seed hairs will be fragments or entire seed hairs with essentially no remnant of a seed portion of the host non-*gossypium* plant attached. However, individualized seed hairs can also comprise a minor fraction of seed hairs retaining of a seed portion of the host non-*gossypium* plant still attached, as well as a minor fraction of seed hairs in the form of a plurality of seed hairs bound by their individual attachment to a common remnant of a seed portion of the host non-*gossypium* plant. Individualized seed hairs may comprise a portion of a pulp or mass further comprising other materials. Other materials includes non-seed hair-bearing fragments of the host plant.

The length and coarseness of the fibers including individualized seed hair fibers may be determined using a Kajaani FiberLab Fiber Analyzer commercially available from Metso Automation, Kajaani Finland. As used herein, fiber length is defined as the "length weighted average fiber length". The instructions supplied with the unit detail the formula used to arrive at this average. The recommended method used to determine fiber lengths and coarseness of fiber specimens essentially the same as detailed by the manufacturer of the Fiber Lab. However, the recommended consistencies for charging to the Fiber Lab are somewhat lower than recommended by the manufacturer since this gives more reliable operation. Short fiber furnishes, as defined herein, should be diluted to 0.02-0.04% prior to charging to the instrument. Long fiber furnishes, as defined herein, should be diluted to 0.15%-0.30%. Alternatively, the length and coarseness of the short fibers and/or long fibers may be determined by sending the short fibers and/or long fibers to an outside contract lab, such as Integrated Paper Services, Appleton, Wis.

In one example of the present invention, the individualized seed hairs may be classified to enrich the individualized seed hair content at the expense of mass not constituting individualized seed hairs.

Individualized seed hairs may be converted into chemical derivatives including but not limited to cellulose derivatives, for example, regenerated cellulose such as rayon; cellulose ethers such as methyl cellulose, carboxymethyl cellulose, and hydroxyethyl cellulose; cellulose esters such as cellulose acetate and cellulose butyrate; and nitrocellulose. Individualized seed hairs may also be used in their physical form, usually fibrous, and herein referred to "seed hair fibers", as a component of fibrous structures.

The present invention is directed at individualized seed hairs, chemical derivatives from individualized seed hairs, and soft fibrous structures comprising individualized seed hairs and the processes for individualizing the seed hairs and incorporating the individualized seed hairs into soft fibrous structures.

*Gossypium* seed borne fibers, i.e., such as lint and/or linters, can be present with the individualized seed hairs of the present invention. Fibers from hairs arising from the seed, pod or fruit case portions of plants and exceeding an average length of about 7 mm can as well be present with the individualized seed hairs of the present invention. However, in either of these cases, they cannot be the only constituent in the individualized seed hairs or the soft fibrous structures of the present invention.

A seed hair may be formed by one cell or many cells.

Seed hairs are typically fibers.

Seed hairs are different from trichome fibers in that they are not attached to non-seed portions of a plant. For example, seed hair fibers, unlike trichome fibers, are not attached to a non-seed epidermis.

Further, seed hairs are different from nonwood bast and/or core fibers in that they are not attached to the bast, also known as phloem, or the core, also known as xylem portions of a nonwood dicotyledonous plant stem. Nonlimiting examples of plants which have been used to yield nonwood bast fibers and/or nonwood core fibers include kenaf, jute, flax, ramie and hemp.

Further seed hairs are different from monocotyledonous plant derived fibers such as those derived from cereal straws (wheat, rye, barley, oat, etc), stalks (corn, cotton, sorghum, *Hesperaloe funifera*, etc.), canes (bamboo, bagasse, etc.), grasses (esparto, lemon, sabai, switchgrass, etc), since such monocotyledonous plant derived fibers are not attached to an epidermis of a plant.

Further, seed hair fibers are different from leaf fibers in that they do not originate from within the leaf structure. Sisal and abaca are sometimes liberated as leaf fibers.

Finally, seed hair fibers are different from wood pulp fibers since wood pulp fibers are not outgrowths from the epidermis of a plant; namely, a tree. Wood pulp fibers rather originate from the secondary xylem portion of the tree stem.

"Fiber" as used herein means an elongate physical structure having an apparent length greatly exceeding its apparent diameter, i.e. a length to diameter ratio of at least about 10. Fibers having a non-circular cross-section and/or tubular shape are common; the "diameter" in this case may be considered to be the diameter of a circle having cross-sectional area equal to the cross-sectional area of the fiber. More specifically, as used herein, "fiber" refers to fibrous structure-making fibers. The present invention contemplates the use of a variety of fibrous structure-making fibers, such as, for example, natural fibers or synthetic fibers, or any other suitable fibers, and any combination thereof.

Natural fibrous structure-making fibers useful in the present invention include animal fibers, mineral fibers, other plant fibers (in addition to the seed hairs of the present invention) and mixtures thereof. Animal fibers may, for example, be selected from the group consisting of: wool, silk and mixtures thereof. The other plant fibers may, for example, be derived from a plant selected from the group consisting of: wood, cotton, cotton linters, flax, sisal, abaca, hemp, hesperaloe, jute, bamboo, bagasse, kudzu, corn, sorghum, gourd, agave, loofah and mixtures thereof.

Wood fibers; often referred to as wood pulps include chemical pulps, such as kraft sulfate) and sulfite pulps, as well as mechanical and semi-chemical pulps including, for example, groundwood, thermomechanical pulp, chemi-mechanical pulp (CMP), chemi-thermomechanical pulp (CTMP), neutral semi-chemical sulfite pulp (NSCS). Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified and/or layered web. U.S. Pat. Nos. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

The wood pulp fibers may be short (typical of hardwood fibers) or long (typical of softwood fibers). Nonlimiting examples of short fibers include fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Nonlimiting examples of long fibers include fibers derived from Pine, Spruce, Fir, Tamarack, Hemlock, Cypress, and Cedar. Softwood fibers derived from the kraft process and originating from more-northern climates may be preferred. These are often referred to as northern softwood kraft (NSK) pulps.

Synthetic fibers may be selected from the group consisting of: wet spun fibers, dry spun fibers, melt spun (including melt blown) fibers, synthetic pulp fibers and mixtures thereof. Synthetic fibers may, for example, be comprised of cellulose (often referred to as "rayon"); cellulose derivatives such as esters, ether, or nitrous derivatives; polyolefins (including polyethylene and polypropylene); polyesters (including polyethylene terephthalate); polyamides (often referred to as "nylon"); acrylics; non-cellulosic polymeric carbohydrates (such as starch, chitin and chitin derivatives such as chitosan); and mixtures thereof.

The web (fibrous structure) of the present invention may comprise fibers, films and/or foams that comprises a hydroxyl polymer and optionally a crosslinking system. Nonlimiting examples of suitable hydroxyl polymers include polyols, such as polyvinyl alcohol, polyvinyl alcohol derivatives, polyvinyl alcohol copolymers, starch, starch derivatives, chitosan, chitosan derivatives, cellulose derivatives such as cellulose ether and ester derivatives, gums, arabinans, galactans, proteins and various other polysaccharides and mixtures thereof. For example, a web of the present invention may comprise a continuous or substantially continuous fiber comprising a starch hydroxyl polymer and a polyvinyl alcohol hydroxyl polymer produced by dry spinning and/or solvent spinning (both unlike wet spinning into a coagulating bath) a composition comprising the starch hydroxyl polymer and the polyvinyl alcohol hydroxyl polymer.

"Fiber Length", "Average Fiber Length" and "Weighted Average Fiber Length", are terms used interchangeably herein all intended to represent the "Length Weighted Average Fiber Length" as determined for example by means of a Kajaani FiberLab Fiber Analyzer commercially available from Metso Automation, Kajaani Finland. The instructions supplied with the unit detail the formula used to arrive at this average. The recommended method for measuring fiber length using this instrument is essentially the same as detailed by the manufacturer of the FiberLab in its operation manual. The recommended consistencies for charging to the FiberLab are somewhat lower than recommended by the manufacturer since this gives more reliable operation. Short fiber furnishes, as defined herein, should be diluted to 0.02-0.04% prior to charging to the instrument. Long fiber furnishes, as defined herein, should be diluted to 0.15%-0.30%.

Alternatively, fiber length may be determined by sending the short fibers to a contract lab, such as Integrated Paper Services, Appleton, Wis.

Fibrous structures may be comprised of a combination of long fibers and short fibers.

Nonlimiting examples of suitable long fibers for use in the fibrous structures of present invention include fibers that exhibit an average fiber length of less than about 7 mm and/or less than about 5 mm and/or less than about 3 mm and/or less than about 2.5 mm and/or from about 1 mm to about 5 mm and/or from about 1.5 mm to about 3 mm and/or from about 1.8 mm to about 4 mm and/or from about 2 mm to about 3 mm.

Nonlimiting examples of suitable short fibers suitable for use in the fibrous structures of present invention include fibers that exhibit an average fiber length of less than about 5 mm and/or less than about 3 mm and/or less than about 1.2 mm and/or less than about 1.0 mm and/or from about 0.4 mm to about 5 mm and/or from about 0.5 mm to about 3 mm and/or from about 0.5 mm to about 1.2 mm and/or from about 0.6 mm to about 1.0 mm.

Individualized seed hair fibers for use in the fibrous structures of the present invention may be characterized as either long fibers or short fibers.

"Fibrous structure" as used herein means a structure that comprises one or more fibers. In one example, a fibrous structure according to the present invention means an orderly arrangement of fibers within a structure in order to perform a function. Nonlimiting examples of fibrous structures of the present invention include composite materials (including reinforced plastics and reinforced cement), paper, fabrics (including woven, knitted, and non-woven), and absorbent pads (for example for diapers or feminine hygiene products). A bag of loose fibers is not a fibrous structure in accordance with the present invention.

Nonlimiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous suspension is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

"Sanitary tissue product" comprises one or more finished fibrous structures, converted or not, that is useful as a wiping implement for post-urinary and post-bowel movement cleaning (toilet tissue), for otorhinolaryngological discharges (facial tissue), and multi-functional absorbent and cleaning uses (absorbent towels).

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a sanitary tissue product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$) is measured. The basis weight ($g/m^2$) is calculated by dividing the average weight (g) by the average area of the samples ($m^2$).

"Dry Tensile Strength" (or simply "Tensile Strength" as used herein) of a fibrous structure of the present invention and/or a paper product comprising such fibrous structure is measured as follows. One (1) inch by five (5) inch (2.5 cm×12.7 cm) strips of fibrous structure and/or paper product comprising such fibrous structure are provided. The strip is placed on an electronic tensile tester Model 1122 commercially available from Instron Corp., Canton, Mass. in a conditioned room at a temperature of 73° F.±4° F. (about 28° C.±2.2° C.) and a relative humidity of 50%±10%. The cross-head speed of the tensile tester is 2.0 inches per minute (about 5.1 cm/minute) and the gauge length is 4.0 inches (about 10.2 cm). The Dry Tensile Strength can be measured in any direction by this method. The "Total Dry Tensile Strength" or "TDT" is the special case determined by the arithmetic total of MD and CD tensile strengths of the strips.

"Modulus" or "Tensile Modulus" as used herein means the slope tangent to the load elongation curve taken at the point corresponding to 15 g/cm-width upon conducting a tensile measurement as specified in the foregoing.

"Peak Load Stretch" (or simply "Stretch") as used herein is determined by the following formula:

$$\frac{\text{Length of Fibrous Structure}_{PL} - \text{Length of Fibrous Structure}_{I}}{\text{Length of Fibrous Structure}_{I}} \times 100$$

wherein:

Length of Fibrous Structure$_{PL}$ is the length of the fibrous structure at peak load;

Length of Fibrous Structure$_{I}$ is the initial length of the fibrous structure prior to stretching;

The Length of Fibrous Structure$_{PL}$ and Length of Fibrous Structure$_{I}$ are observed while conducting a tensile measurement as specified in the above. The tensile tester calculates the stretch at Peak Load. Basically, the tensile tester calculates the stretches via the formula above.

"Caliper" as used herein means the macroscopic thickness of a sample. Caliper of a sample of fibrous structure according to the present invention is determined by cutting a sample of the fibrous structure such that it is larger in size than a load foot loading surface where the load foot loading surface has a circular surface area of about 3.14 $in^2$ (20.3 $cm^2$). The sample is confined between a horizontal flat surface and the load foot loading surface. The load foot loading surface applies a confining pressure to the sample of 15.5 $g/cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in millimeters.

"Apparent Density" or "Density" as used herein means the basis weight of a sample divided by the caliper with appropriate conversions incorporated therein. Apparent density used herein has the units $g/cm^3$.

"Soft Fibrous Structure" as used herein refers to a fibrous structure having a density less than about 0.2 $g/cm^3$ and/or a stretch at peak load of more than about 15%.

Seed Hairs

Many plants have seed hairs. Those skilled in the art will recognize that some plants will have seed hairs of sufficient mass fraction and/or the overall growth rate and/or robustness of the plant so that they may offer attractive agricultural economy to make them more suitable for a large commercial process, especially for fibrous structures, such as disposable fibrous structures. Seed hairs may have a wide range of morphology and chemical properties. For example, the seed hairs may be in the form of fibers; namely, seed hair fibers. Such seed hair fibers may have a high length to diameter ratio.

The following sources are offered as nonlimiting examples of seed hair-bearing plants (suitable sources) for obtaining seed hairs, especially seed hair fibers.

The before-mentioned plants: kapok, *Ceiba pentrandra*, and milkweed, *Asclepias speciosa*, are non-limiting suitable sources for individualized seed hairs according to the present invention.

The common cattail, *Typha latifolia*, and the broadleaf cattail, *Typha augustfolia*, of the family Typhaceae bear a seed head which can be used a non-limiting source of individualized seed hairs according to the present invention.

Alaska cotton, *Eriophorum scheuchzeri*, of the Cyperaceae family bear a seed head which can be used a non-limiting source of individualized seed hairs according to the present invention.

Sedge grass, also known as broomsedge, *Andropogon virginicus* of the Gramineae family bears seed hairs which can be used a non-limiting source of individualized seed hairs according to the present invention.

Some members of the Asteraceae family bear seed hairs which can be used a non-limiting source of individualized seed hairs according to the present invention. These include varieties of salsify, *Tragopogon dubius, Tragopogon pratensis*, and *Tragopogon porrifolius*; the wild thistle artichoke, *Cynara cardunculus*; the common dandelion, *Taraxacum officinale*; the catsear, or false dandelion, (*Hypochaeris radicata*); the scotch cottonthistle, *Onopordum acanthium*, and members of the genus *Cirsium*, known as thistles, including *Cirsium arvense, Cirsium canovirens, Cirsium douglasii* var. *brewerii, Cirsium peckii, Cirsium scariosum, Cirsium subniveum, Cirsium undulatum*, and *Cirsium vulgare*.

In one example, a seed hair suitable for use in the fibrous structures of the present invention comprises cellulose.

In yet another example, a seed hair suitable for use in the fibrous structures of the present invention comprises a fatty acid.

In still another example, a seed hair suitable for use in the fibrous structures of the present invention is hydrophobic.

Figure 2:
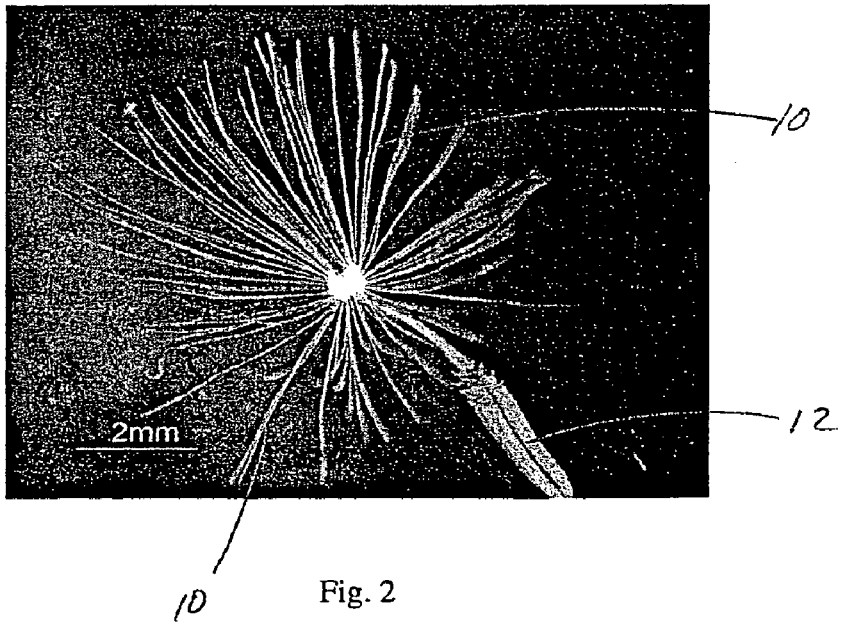
FIG. 2 is a light micrograph illustrating a single seed and associated seed hairs extracted from the seed globe on the common dandelion *Taraxacum officinale.*

As shown in FIG. 1, numerous seed hairs 10 are present on a mature seed globe from a common dandelion. FIG. 2 shows a single seed 12 and associated seed hairs 10 extracted from a seed globe from a common dandelion.

Figure 3:
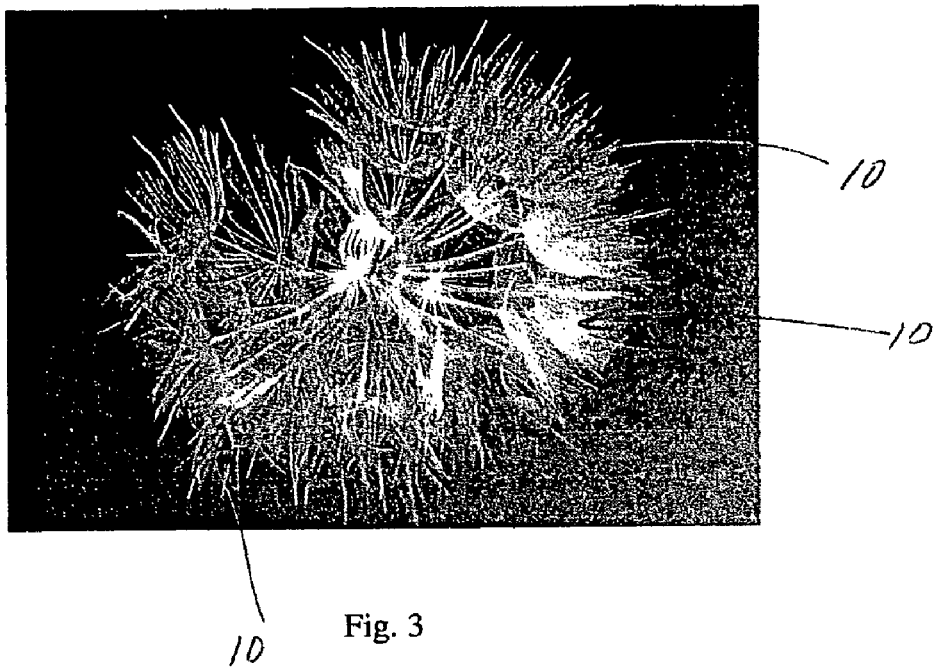
FIG. 3 is a light micrograph of a mature seed globe illustrating seed hairs present on one of the salsify species, *Tragopogon dubius;*
Figure 4:
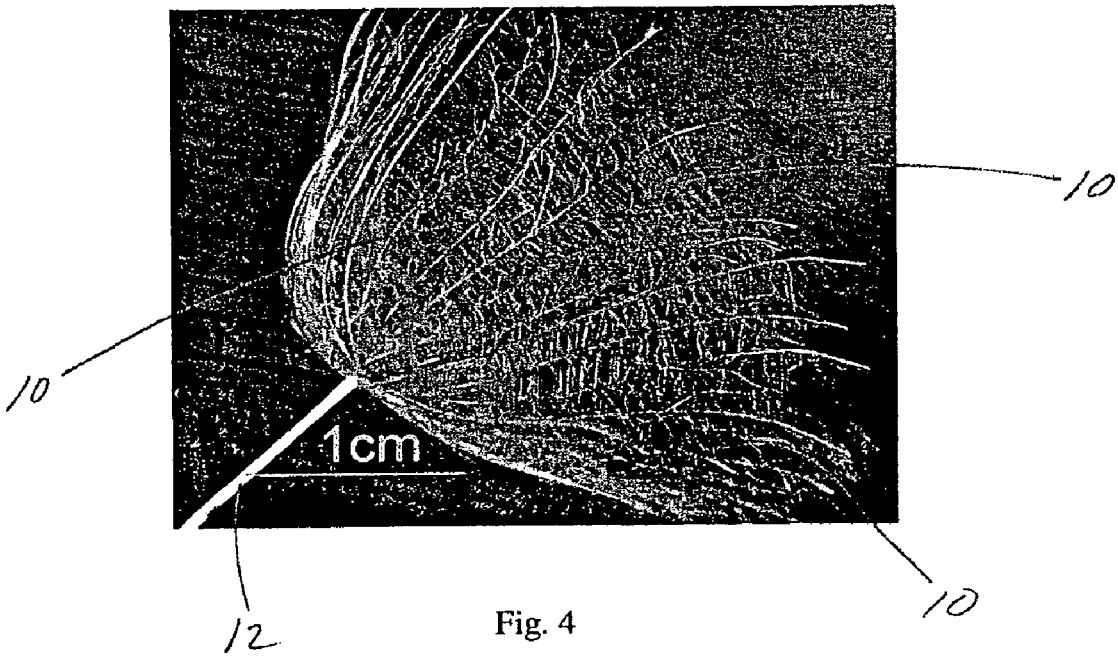
FIG. 4 is a light micrograph illustrating a single seed and associated seed hairs extracted from the seed globe on one of the salsify species, *Tragopogon dubius.*

As shown in FIG. 3, numerous seed hairs 10 are present on a mature seed globe from a salsify species. FIG. 4 shows a single seed 12 and associated seed hairs 10 extracted from a seed globe from a salsify species.

Figure 5:
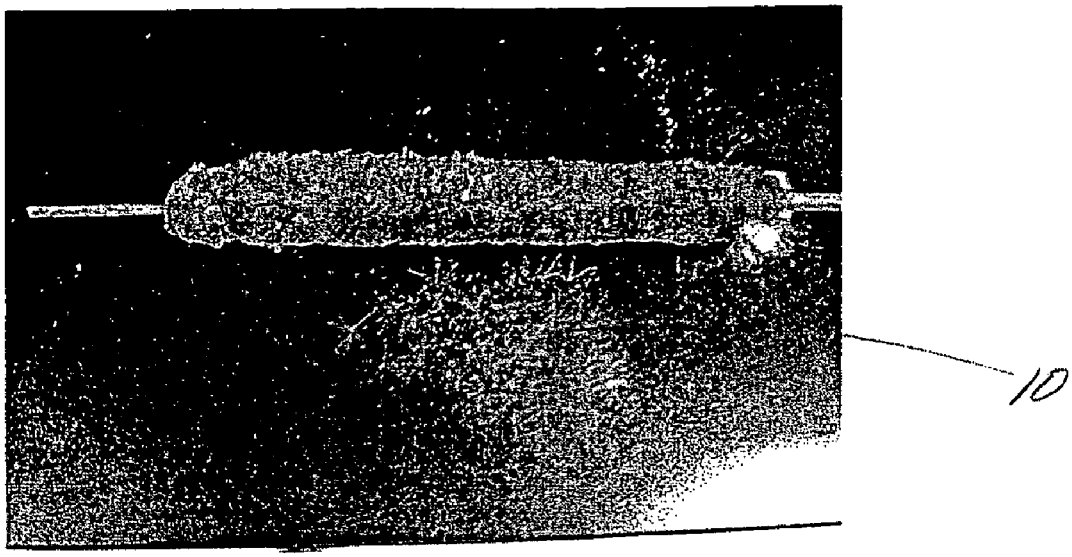
FIG. 5 is a light micrograph of a mature seed head of the common cattail, *Typha latifolia;*
Figure 6:
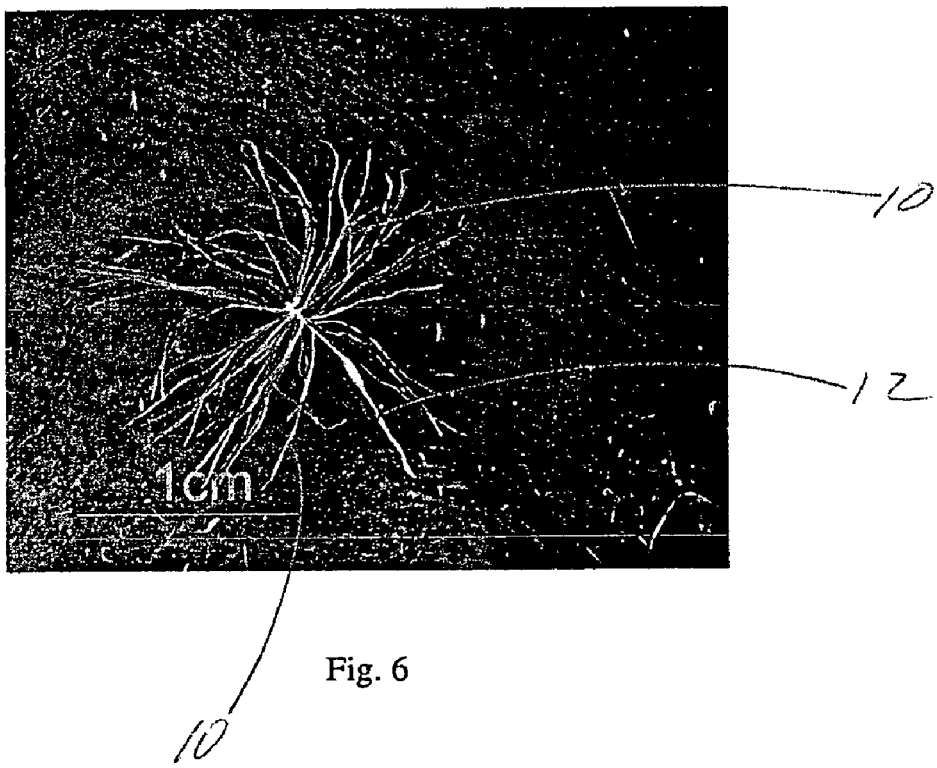
FIG. 6 is a light micrograph illustrating a single seed and associated seed hairs extracted from the seed head on the common cattail, *Typha latifolia.*
Figure 7:
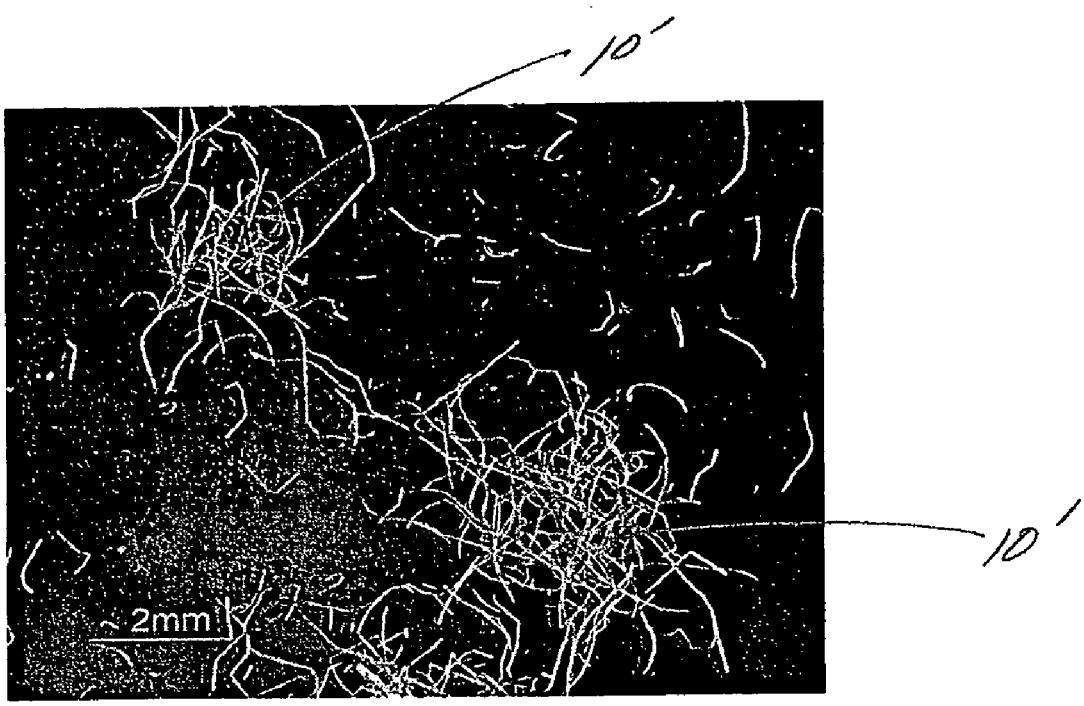
FIG. 7 is a light micrograph illustrating individualized seed hairs derived from the seed head on the common cattail, *Typha latifolia.*

As shown in FIG. 5, numerous seed hairs 10 are present on a mature seed head from a common cattail. FIG. 6 shows a single seed 12 and associated seed hairs 10 extracted from a seed head from a common cattail. FIG. 7 shows individualized seed hairs 10' obtained from a seed head from a common cattail.

Processes for Individualizing Seed Hairs

Individualized seed hairs may be obtained from suitable plant sources by any suitable method known in the art. Non-limiting examples of suitable methods include the step of separating a seed hair from an epidermis of a seed portion of a plant.

Non-limiting examples of the step of separating include mechanical and/or chemical process steps.

Nonlimiting examples of mechanical process steps include contacting an epidermis of a seed portion of a seed hairs-bearing plant with a device such that a seed hair is separated from the epidermis. Nonlimiting examples of such devices for use in such a contacting step include a ball mill, a pin mill, a hammermill, a rotary knife cutter such as a "Wiley Mill", and/or a "CoMil" sold by Quadro Engineering of Waterloo, Ontario, Canada.

In one example, an epidermis of a seed portion of a seed hairs-bearing plant is subjected to a mill device that comprises a screen, in particular, a slotted screen, designed to better separate the seed hairs-bearing material from the epidermis.

After seed hairs-bearing material is subjected to the mechanical process to liberate them from the seed or seed pod epidermis, it is preferred to enrich the pulp or fiber mass' content of individualized seed hairs. This may be carried out by means of screening or air classifying equipment well known in the art. A suitable air classifier is the Hosokawa Alpine 50ATP, sold by Hosokawa Micron Powder Systems of Summit, N.J.

In one example, the pulp or fiber mass' content of the individualized seed hairs is subjected to one or more air classifying steps and then the pulp or fiber mass remaining after the air classifying step(s) is subjected to one or more screeners to further enrich the pulp or fiber mass' content of individualized seed hairs.

Seed hair material, before or after liberation of individualized seed hairs from the host plant, may be further subjected to chemical treatment to improve hydrophilicity, e.g. it may be treated with a surfactant or a polymer with surface active agent properties such EO-PO polymers sold under the trade name "Pluronic" by BASF of Florham Park, N.J., or an ethoxylated polyester such as "Texcare 4060" sold by Clariant Inc. (Americas Div) of Wilmington, Del. Water dispersions of seed hairs may be further treated with antifoam compounds to reduce their tendency to retain air and thus float. An example compound is "DC 2310", sold by Dow Corning of Midland, Mich. Additional treatments include extraction to remove certain hydrophobic components such as fatty acids. Such extraction may be done in aqueous, optionally hot aqueous, medium optionally containing surfactants to bind with and remove the hydrophobes. Non-aqueous or two phase systems may also be practiced, wherein the seed hair hydrophobes are dissolved and/or dispersed in a non-water solvent and/or a non-water miscible solvent.

Alternatively, the creation of individualized seed hairs may employ wet processes practiced on the seed hair bearing plant, optionally in combination with mechanical treatment. This includes processes analogous to the well known (in the wood pulp industry) groundwood, refiner-mechanical pulping, or thermo-mechanical pulping means, followed optionally by wet classification to enrich the individualized seed hairs. Wet processes also include chemical processes, non-limiting examples of which include contacting an epidermis of a non-seed portion of a seed hair-bearing plant with a chemical composition such that a seed hair is separated from the epidermis. Suitable chemical process steps include the chemical process steps of the well-known (in the wood pulp industry) kraft, sulfite and/or soda processes, including chemi-mechanical variations.

In one example, a seed hair is separated from a seed hair-bearing plant by a method comprising the steps of: a) drying the seed hair-bearing plant; b) contacting the seed hair-bearing plant with a device such that the seed hair is separated from the seed hair-bearing plant's seed epidermis; and c) classifying the seed hair from the seed hair-bearing plant's chaff; and d) optionally, combusting the seed hair-bearing plant's chaff; and e) using energy obtained from the combusting step d) for drying additional seed hair-bearing plants in step a).

In one example, the dried seed hair-bearing plant resulting from step a) comprises less than about 10% by weight of moisture.

Nonlimiting examples of suitable classifying equipment and/or processes include air classifiers and/or screen classifiers.

Non-limiting examples of chemical processes for liberating seed hairs from a seed hair-bearing plant include the well-known kraft, or sulfite, or soda processes.

Fibrous Structures

The fibrous structures of the present invention may comprise a seed hair, especially a seed hair fiber. In one example, a seed hair fiber suitable for use in the fibrous structures of the present invention exhibit a fiber length of from about 100 μm to about 7000 μm and a width of from about 3 μm to about 30 μm.

In addition to a seed hair, other fibers and/or other ingredients may also be present in the fibrous structures of the present invention.

Fibrous structures according to this invention may contain from about 0.1% to about 100% and/or from about 0.5% to about 50% and/or from about 1% to about 40% and/or from about 2% to about 30% and/or from about 5% to about 25% seed hairs.

Nonlimiting types of fibrous structures according to the present invention include conventionally felt-pressed fibrous structures; pattern densified fibrous structures; and high-bulk, uncompacted fibrous structures. The fibrous structures may be of a homogenous or multilayered (two or three or more layers) construction; and the sanitary tissue products made therefrom may be of a single-ply or multi-ply construction.

The fibrous structures and/or sanitary tissue products of the present invention may exhibit a basis weight of between about 10 $g/m^2$ to about 120 $g/m^2$ and/or from about 14 $g/m^2$ to about 80 $g/m^2$ and/or from about 20 $g/m^2$ to about 60 $g/m^2$.

The structures and/or sanitary tissue products of the present invention may exhibit a total (i.e. sum of machine direction and cross machine direction) dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in).

The fibrous structure and/or sanitary tissue products of the present invention may exhibit a density of less than about 0.60 $g/cm^3$ and/or less than about 0.30 $g/cm^3$ and/or less than about 0.20 $g/cm^3$ and/or less than about 0.10 $g/cm^3$ and/or less than about 0.07 $g/cm^3$ and/or less than about 0.05 $g/cm^3$ and/or from about 0.01 $g/cm^3$ to about 0.20 $g/cm^3$ and/or from about 0.02 $g/cm^3$ to about 0.10 $g/cm^3$.

The fibrous structures and/or sanitary tissue products of the present invention may exhibit a stretch at peak load (measured in direction of maximum stretch at peak load) of at least about 10% and/or at least about 15% and/or at least about 20% and/or from about 10% to about 70% and/or from about 10% to about 50% and/or from about 15% to about 40% and/or from about 20% to about 40%.

In one example, the fibrous structure of the present invention is a pattern densified fibrous structure characterized by having a relatively high-bulk region of relatively low fiber density and an array of densified regions of relatively high fiber density. The high-bulk field is characterized as a field of pillow regions. The densified zones are referred to as knuckle regions. The knuckle regions exhibit greater density than the pillow regions. The densified zones may be discretely spaced within the high-bulk field or may be interconnected, either fully or partially, within the high-bulk field. Typically, from about 8% to about 65% of the fibrous structure surface comprises densified knuckles, the knuckles may exhibit a relative density of at least 125% of the density of the high-bulk field. Processes for making pattern densified fibrous structures are well known in the art as exemplified in U.S. Pat. Nos. 3,301,746, 3,974,025, 4,191,609 and 4,637,859.

The fibrous structures comprising a seed hair in accordance with the present invention may be in the form of through-air-dried fibrous structures, differential density fibrous structures, differential basis weight fibrous structures, wet laid fibrous structures, air laid fibrous structures (examples of which are described in U.S. Pat. Nos. 3,949,035 and 3,825,381), conventional dried fibrous structures, creped or uncreped fibrous structures, patterned-densified or non-patterned-densified fibrous structures, compacted or uncompacted fibrous structures, nonwoven fibrous structures comprising synthetic or multicomponent fibers, homogeneous or multilayered fibrous structures, double re-creped fibrous structures, foreshortened fibrous structures, co-form fibrous structures (examples of which are described in U.S. Pat. No. 4,100,324) and mixtures thereof.

In one example, the air laid fibrous structure is selected from the group consisting of thermal bonded air laid (TBAL) fibrous structures, latex bonded air laid (LBAL) fibrous structures and mixed bonded air laid (MBAL) fibrous structures.

The fibrous structures may exhibit a substantially uniform density or may exhibit differential density regions, in other words regions of high density compared to other regions within the patterned fibrous structure. Typically, when a fibrous structure is not pressed against a cylindrical dryer, such as a Yankee dryer, while the fibrous structure is still wet and supported by a through-air-drying fabric or by another fabric or when an air laid fibrous structure is not spot bonded, the fibrous structure typically exhibits a substantially uniform density.

In addition to a seed hair, the fibrous structure may comprise other additives, such as wet strength additives, softening additives, solid additives (such as starch, clays), dry strength resins, wetting agents, lint resisting agents, absorbency-enhancing agents, immobilizing agents, especially in combination with emollient lotion compositions, antiviral agents including organic acids, antibacterial agents, polyol polyesters, antimigration agents, polyhydroxy plasticizers and mixtures thereof. Such other additives may be added to the fiber furnish, the embryonic fibrous web and/or the fibrous structure.

Such other additives may be present in the fibrous structure at any level based on the dry weight of the fibrous structure.

The other additives may be present in the fibrous structure at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

The fibrous structures of the present invention may be subjected to any suitable post processing including, but not limited to, printing, embossing, calendaring, slitting, folding, combining with other fibrous structures, and the like.

Processes for Making Individualized Seed Hair-Containing Soft Fibrous Structures Any suitable process for making fibrous structures known in the art may be used to make individualized seed hair-containing soft fibrous structures of the present invention.

In one example, the individualized seed hair-containing soft fibrous structures of the present invention are made by a wet laid fibrous structure making process.

In another example, the individualized seed hair-containing soft fibrous structures of the present invention are made by an air laid fibrous structure making process.

In one example, an individualized seed hair-containing soft fibrous structure is made by the process comprising the steps of: a) preparing a fiber furnish (slurry) by mixing a seed hair with water; b) depositing the fiber furnish on a foraminous forming surface to form an embryonic fibrous web; and c) drying the embryonic fibrous web.

In one example, a fiber furnish comprising individualized seed hairs, in the form of fiber, is deposited onto a foraminous forming surface via a headbox.

The following Example illustrates a nonlimiting example for the preparation of sanitary tissue product comprising a soft fibrous structure according to the present invention on a pilot-scale Fourdrinier fibrous structure making machine.

Individualized seed hairs are first prepared from the common cattail, by passing air dried seed heads of *Typha latifolia* through a rotary knife cutter (Wiley mill, manufactured by the C. W. Brabender Co. located in South Hackensack, N.J.) equipped with an attrition screen having ¼" holes. Exiting the Wiley mill is a composite fluff constituting the individualized seed hairs together with chunks of seed material. The individualized seed hair fluff is then passed through an air classifier (Hosokawa Alpine 50ATP); the "accepts" or "fine" fraction from the classifier is greatly enriched in individualized seed hairs while the "rejects" or "coarse" fraction is primarily seed particles with only a lower fraction of individualized seed hairs. A squirrel cage speed of 9000 rpm, an air pressure resistance of 10-15 mbar, and a feed rate of about 10 g/min are used on the 50 ATP. The resulting individualized seed hair material (fines) is mixed with a 10% aqueous dispersion of "Texcare 4060" to add about 10% by weight "Texcare 4060" by weight of the bone dry weight of the individualized seed hairs followed by slurrying the "Texcare"-treated seed hairs in water at 3% consistency using a conventional repulper. This slurry is passed through a stock pipe toward another stock pipe containing eucalyptus fiber slurry.

The aqueous slurry of eucalyptus fibers is prepared at about 3% by weight using a conventional repulper. This slurry is also passed through a stock pipe toward the stock pipe containing the seed hairs fiber slurry.

The 3% seed hair slurry is combined with the 3% eucalyptus fiber slurry in a proportion which yields about 13.3% seed hair fibers and 86.7% eucalyptus fibers. The stockpipe containing the combined seed hair and eucalyptus fiber slurries is directed toward the headbox of a fourdrinier machine.

Separately, an aqueous slurry of NSK fibers of about 3% by weight is made up using a conventional repulper.

In order to impart temporary wet strength to the finished fibrous structure, a 1% dispersion of temporary wet strengthening additive (e.g., Parez® 750) is prepared and is added to the NSK fiber stock pipe at a rate sufficient to deliver 0.3% temporary wet strengthening additive based on the dry weight of the NSK fibers. The absorption of the temporary wet strengthening additive is enhanced by passing the treated slurry through an in-line mixer.

The seed hair and eucalyptus fiber slurry is diluted with white water at the inlet of a fan pump to a consistency of about 0.15% based on the total weight of the eucalyptus and seed hair fiber slurry. The NSK fibers, likewise, are diluted with white water at the inlet of a fan pump to a consistency of about 0.15% based on the total weight of the NSK fiber slurry. The eucalyptus/seed hair fiber slurry and the NSK fiber slurry are both directed to a layered headbox capable of maintaining the slurries as separate streams until they are deposited onto a forming fabric on the Fourdrinier.

"DC 2310" antifoam is dripped into the wirepit to control foam to maintain whitewater levels of 10 ppm of antifoam.

The fibrous structure making machine has a layered headbox having a top chamber, a center chamber, and a bottom chamber. The eucalyptus/seed hair combined fiber slurry is pumped through the top and bottom headbox chambers and, simultaneously, the NSK fiber slurry is pumped through the center headbox chamber and delivered in superposed relation onto the Fourdrinier wire to form thereon a three-layer embryonic web, of which about 70% is made up of the eucalyptus/seed hair fibers and 30% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The speed of the Fourdrinier wire is about 750 fpm (feet per minute).

The embryonic wet web is transferred from the Fourdrinier wire, at a fiber consistency of about 15% at the point of transfer, to a patterned drying fabric. The speed of the patterned drying fabric is the same as the speed of the Fourdrinier wire. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 12 mils above the supporting fabric. A suitable process for making the patterned drying fabric is described in published application US 2004/0084167 A1.

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed creping adhesive. The creping adhesive is an aqueous dispersion with the actives consisting of about 22% polyvinyl alcohol, about 11% CREPETROL A3025, and about 67% CREPETROL R6390. CREPETROL A3025 and CREPETROL R6390 are commercially available from Hercules Incorporated of Wilmington, Del. The creping adhesive is delivered to the Yankee surface at a rate of about 0.15% adhesive solids based on the dry weight of the web. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The fibrous structure is wound in a roll using a surface driven reel drum having a surface speed of about 656 feet per minute. The resulting soft fibrous structure having a density of about 0.09 g/cm$^3$ may be subsequently converted into a two-ply sanitary tissue product having a basis weight of about 50 g/m$^2$.

The sanitary tissue paper product is very soft and absorbent.

All documents cited in the Detailed Description of the Invention are, in relevant part, incorporated herein by reference; the citation of any document is not to be construed as an admission that it is prior art with respect to the present invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A single- or multi-ply sanitary tissue product comprising a fibrous structure comprising individualized seed hairs derived from a plant in the Typhaceae family wherein the fibrous structure further comprises an additive selected from the group consisting of wet strength additives, softening additives, starch, clay, dry strength resins, wetting agents, lint resisting agents, absorbency-enhancing agents, immobilizing agents, lotion compositions, antiviral agents, antibacterial agents, polyol polyesters, antimigration agents, polyhydroxy plasticizers and mixtures thereof.

2. The single- or multi-ply sanitary tissue product according to claim 1 wherein the individualized seed hairs are fibers.

3. The single- or multi-ply sanitary tissue product according to claim 1 wherein the individualized seed hairs are derived from a plant selected from the group consisting of *Typha latifolia* and *Typha augustfolia*.

4. The single- or multi-ply sanitary tissue product according to claim 1 wherein the fibrous structure further comprises a wood pulp fiber.

5. The single- or multi-ply sanitary tissue product according to claim 1 wherein the fibrous structure further comprises a synthetic fiber.

6. The single- or multi-ply sanitary tissue product according to claim 1 wherein the individualized seed hairs comprise at least 0.1% by weight of the fibrous structure.

7. The single- or multi-ply sanitary tissue product according to claim 1 wherein the individualized seed hairs comprise less than 50% by weight of the fibrous structure.

8. A method for individualizing a non-*gossypium* seed hair from an epidermis of a seed, pod, or fruit case portion of a seed hair-bearing plant, the process comprising the step of contacting said seed, pod, or fruit case portion with a device such that non-*gossypium* seed hair is separated from said epidermis.

9. The method according to claim 8 wherein the device comprises a mill comprising a slot screen.

10. The method according to claim 8 wherein the device comprises an air classifier.

11. The method according to claim 10 wherein the device further comprises a screen.

12. A method for individualizing a non-*gossypium* seed hair from an epidermis of a seed, pod, or fruit case portion of a seed hair-bearing plant, the process comprising the step of contacting said seed, pod, or fruit case portion with a chemical to promote that said non-*gossypium* seed hair is separated from said epidermis.

13. A method for making an individualized seed hair-containing fibrous structure comprising the steps of:

a) preparing a fiber furnish by mixing an individualized seed hair with water;

b) depositing the fiber furnish on a foraminous forming surface to form an embryonic fibrous web; and c) drying the embryonic fibrous web.

* * * * *